United States Patent [19]

Hammer et al.

[11] Patent Number: 4,463,280

[45] Date of Patent: Jul. 31, 1984

[54] SHAPED DISCHARGE LAMP WITH STARTING AID

[75] Inventors: Edward E. Hammer, Mayfield Village; Charles E. Beck, Chesterland, both of Ohio

[73] Assignee: General Electric Company, Schenectady, N.Y.

[21] Appl. No.: 368,499

[22] Filed: Apr. 15, 1982

[51] Int. Cl.[3] ..... H01J 17/00; H01J 61/00

[52] U.S. Cl. ..... 313/594; 313/634

[58] Field of Search ..... 313/594, 601, 602, 634, 313/234, 607, 492

[56] References Cited

U.S. PATENT DOCUMENTS 2,795,724 6/1957 Beeson ..... 313/594
3,548,241 12/1970 Rasch et al. ..... 313/490 X
4,138,621 2/1979 Downing et al. ..... 313/113
4,321,502 3/1982 Hammer et al. ..... 313/594
4,422,010 12/1983 Hammer ..... 313/634 X

*Primary Examiner*—David K. Moore
*Assistant Examiner*—K. Wieder
*Attorney, Agent, or Firm*—Philip L. Schlamp; Fred Jacob

[57] ABSTRACT

A discharge lamp comprising an elongated bulb shaped so that the ends thereof are substantially closer together than if the bulb were straight and containing electrodes respectively near said ends thereof, electrically interconnected bracing straps around the end regions of the bulb, and a starting aid comprising T-shaped conductive members having bands respectively at least partly around said bulb in the vicinity of each of said electrodes and having stems respectively extending under and clamped by said bracing straps.

5 Claims, 5 Drawing Figures

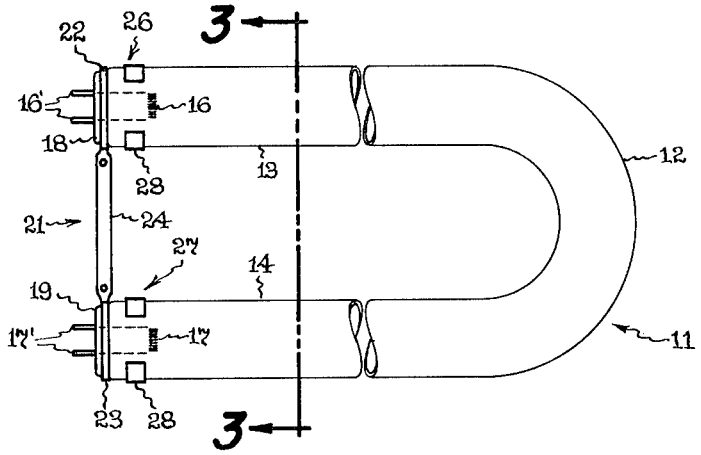
Fig. 2
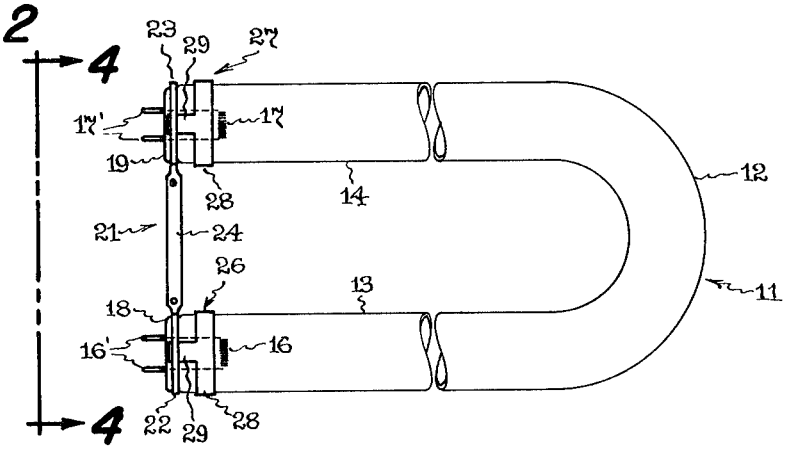
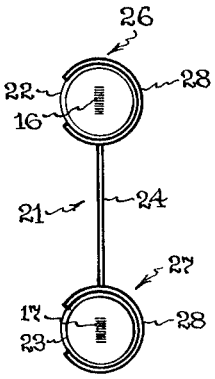
Fig. 3
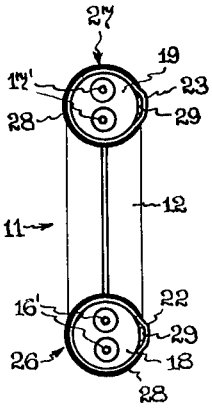
Fig. 4
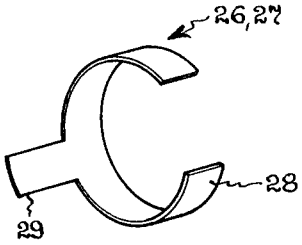
Fig. 5

SHAPED DISCHARGE LAMP WITH STARTING AID

CROSS-REFERENCE TO RELATED APPLICATIONS

Ser. No. 253,089, filed Apr. 13, 1981, Edward E. Hammer, "U-Shaped Discharge Lamp With Starting Aid", now abandoned assigned the same as this invention.

Ser. No. 368,500, filed concurrently herewith, Edward E. Hammer and Charles E. Beck, "Shaped Discharge Lamp With Starting Aid and Starting Strip", assigned the same as this invention.

Ser. No. 368,498, filed concurrently herewith, Edward E. Hammer and Charles E. Beck, "Shaped Discharge Lamp With Starting Aid", assigned the same as this invention.

BACKGROUND OF THE INVENTION

The invention is in the field of discharge lamps, such as fluorescent lamps, having an elongated bulb shaped so that its ends are substantially closer together than if the bulb were straight, and containing electrodes near the ends of the bulb. Examples of such lamps are U-shaped lamps, circular lamps, double spiral lamps, and half-circle lamps.

U.S. Pat. No. 3,548,241 to Rasch discloses a U-shaped fluorescent lamp construction of the type having a support strap clamped around the ends of the lamp to improve its rigidity. The lamp does not employ a starting aid.

The above-referenced patent application to Hammer is directed to U-shaped discharge lamps having conductive starting aid members respectively adjacent to the lamp bulb in the vicinity of its electrodes, and means electrically interconnecting the starting aid members.

SUMMARY OF THE INVENTION

An object of the invention is to provide an improvement in starting aids for U-shaped lamps and other discharge lamps having an elongated bulb shaped so that its ends are substantially closer together than if the bulb were straight, and to improve the start and restart capabilities of such lamps. The term "restart" means turning the lamp on quickly or soon (within several seconds or minutes) after it turns off. Examples are when the light switch is accidentally turned off and is quickly turned on again, and when the power line voltage dips or goes off momentarily.

The invention comprises, a briefly and in a preferred embodiment, a discharge lamp comprising an elongated bulb shaped so that its ends are substantially closer together than if the bulb were straight and containing electrodes respectively near the ends thereof, electrically interconnected bracing straps around the end regions of the bulb and a starting aid comprising a pair of T-shaped conductive means having bands respectively at least partially around said bulb in the vicinity of said electrodes and having stems respectively extending under and clamped by said bracing straps.

BRIEF DESCRIPTION OF THE DRAWINGS

FIG. 1 is a view of one side of a U-shaped discharge lamp in accordance with a preferred embodiment of the invention.

FIG. 2 is a view of the other side of the lamp of FIG. 1.

FIG. 3 is a cross-sectional view taken on the line 3—3 of FIG. 1.

FIG. 4 is a cross-sectional view taken on the line 4—4 of FIG. 2.

FIG. 5 is a perspective view of a starting aid clip used in a preferred embodiment of the invention, two such clips being employed on a lamp.

DESCRIPTION OF THE PREFERRED EMBODIMENTS

The U-shaped discharge lamp of FIG. 1 comprises a U-shaped bulb 11 having a U-bend portion 12 and a pair of mutually parallel straight legs 13, 14. A pair of cathodes 16 and 17 are respectively mounted in the bulb near the ends thereof, and respectively connected to pairs of the lamp's connector terminals 16′ and 17′. A pair of short cylindrical metal end caps 18 and 19 are cemented to the ends of the bulb for supporting the connector terminals 16′ and 17′ by means of an insulative mounting disc in conventional manner. The endmost regions of the bulb 11, over which the end caps 18, 19 fit, conventionally are "necked down" slightly in diameter from that of the rest of the bulb. In order to mutually brace the ends of the bulb 11, a support strap 21 is provided and comprises circular metal bands or straps 22, 23 respectively tightly encircling the end caps 18 and 19, these bands 22 and 23 being attached to and interconnected by a rigid metal lateral strap 24. The lamp described thus far is generally similar to that disclosed in the above-referenced Rasch patent. Conventionally, bulb 11 is internally coated with a phosphor, and contains a quantity of mercury to provide a mercury vapor discharge path in the lamp. Also, a gas fill such as argon is provided in the bulb to aid starting, or in more recent energy-saving lamps the fill gas is a mixture of krypton and argon.

In accordance with the invention, a starting aid for the lamp comprises a pair of electrically conductive members 26, 27 respectively adjacent to the bulb in the vicinity of the plane of the lamp's cathode electrodes 16, 17. In a preferred embodiment, each of the starting aid conductive members 16, 17 comprises a circular band portion 28 which at least partly surrounds and encircles the bulb and preferably is in contact therewith. The band portions 28 preferably extend at least halfway around the bulb circumference, and may comprise closed loops completely encircling the bulb. The starting aid members 26, 27 are electrically interconnected by spatially extending conductive means, rather than by conductive means extending alongside a major portion of the bulb length.

A preferred type of this spatially extending electrical interconnection, which is the subject of the present invention, comprises extension stems 29 integral with and extending from the respective band portions 28; these stems 29 extend respectively under the bracing bands 22, 23 and are securely clamped between these bands and the end caps 18, 19 thus electrically interconnecting the starting aid members 26, 27 via the metal bracing bands 22, 23 and lateral strap 24. The conductive bands 26, 27 may be made of resilient metal so that they clamp snugly onto the bulb, and, alternatively, they and their extending stems 29 can be applied to the bulb in the form of a conductive ink or paint with the stems 29 extending under and contacting the end caps 18, 19.

As has been mentioned above, the above-referenced patent application of Hammer is directed to a U-shaped discharge lamp having electrically interconnected conductive starting aid members respectively at or adjacent to the lamp bulb in the vicinity of the electrodes. These starting aid members, in being in the vicinity of the lamp electrodes, can lie in the plane in which the electrodes lie, or can be ahead of the plane of the electrodes (i.e., at the gas discharge region of the bulb) or behind the plane of the electrodes (i.e., between the plane of the electrodes and the ends of the bulb) up to distances within which they achieve the objective of aiding lamp starting. However, the starting aids improve restart of the lamps only if they are located behind the plane of the lamp electrodes, and can hinder or prevent restart of the lamps if located ahead of the plane of the electrodes. "Restart" is a condition when the lamp is to be restarted shortly (within several seconds) after it has turned off, such as when the light switch is accidentally turned off and is quickly turned on again, or when the power line voltage momentarily dips or goes off. Thus, preferably the starting aids are located behind the plane of the electrodes and in this position they aid and facilitate restart of the lamps and also aid and facilitate initial start of the lamps. The term "initial start" as used herein means starting the lamp after it has been off for a considerable time such as more than a few minutes. This is the subject of the above-referenced patent application Ser. No. 368,498.

While preferred embodiments and modifications of the invention have been shown and described, various other embodiments and modifications thereof will become apparent to persons skilled in the art and will fall within the scope of the invention as defined in the following claims.

What we claim as new and desire to secure by Letters Patent of the United States is:

1. A discharge lamp comprising an elongated bulb shaped so that its ends are substantially closer together than if the bulb were straight and containing electrodes respectively near said ends thereof, electrically interconnected bracing straps around the end regions of said bulb, and starting aids comprising conductive means respectively adjacent to said bulb and behind said electrodes and comprising stems respectively extending under and clamped by said bracing straps.

2. A lamp as claimed in claim 1, in which said bulb is U-shaped and having a pair of parallel legs, and in which said interconnecting means comprises a conductive member extending spatially between said pair of parallel legs near said ends thereof.

3. A lamp as claimed in claim 1, in which said starting aid conductive means is T-shaped and comprises a pair of conductive bands respectively extending around at least part of the circumference of said bulb, and further comprising extension stems respectively extending beneath and clamped by said bracing straps.

4. A lamp as claimed in claim 1, in which said lamp is provided with a gas fill comprising krypton.

5. A lamp as claimed in claim 4, in which said gas fill further comprises argon and mercury.

* * * * *